United States Patent [19]

Weimer et al.

[11] Patent Number: 4,609,455

[45] Date of Patent: Sep. 2, 1986

[54] COAL LIQUEFACTION WITH PREASPHALTENE RECYCLE

[75] Inventors: Robert F. Weimer; Robert N. Miller, both of Allentown, Pa.

[73] Assignee: International Coal Refining Company, Allentown, Pa.

[21] Appl. No.: 703,858

[22] Filed: Feb. 21, 1985

Related U.S. Application Data

[63] Continuation-in-part of Ser. No. 543,201, Oct. 19, 1983, abandoned.

[51] Int. Cl.[4] ..... C10G 1/00; C10G 17/04; C10G 21/02; C10G 21/12

[52] U.S. Cl. ..... 208/412; 208/312; 208/315; 208/322; 208/366; 208/417; 208/418; 208/430; 208/435; 208/952

[58] Field of Search ..... 208/8 LE, 366, 312, 208/315, 322

[56] References Cited

U.S. PATENT DOCUMENTS

| | | | |
|---|---|---|---|
| 4,070,268 | 1/1978 | Davis et al. | 208/8 |
| 4,094,766 | 6/1978 | Gorin | 208/10 |
| 4,119,523 | 10/1978 | Baldwin et al. | 208/8 |
| 4,164,466 | 8/1979 | Baldwin et al. | 208/177 |
| 4,189,372 | 2/1980 | Baldwin et al. | 208/8 LE |
| 4,230,556 | 10/1980 | Carr et al. | 208/8 LE |
| 4,251,346 | 2/1981 | Dry et al. | 208/10 |
| 4,328,088 | 5/1982 | Anderson et al. | 208/8 LE |
| 4,334,977 | 6/1982 | Derbyshire et al. | 208/8 LE |
| 4,338,182 | 7/1982 | Vernon et al. | 208/8 LE |
| 4,341,618 | 7/1982 | Stetka et al. | 208/8 LE |
| 4,347,117 | 8/1982 | Bauman et al. | 208/8 LE |
| 4,372,538 | 2/1983 | Kulik et al. | 208/10 |
| 4,374,015 | 2/1983 | Brulé | 208/8 LE |
| 4,377,464 | 3/1983 | Carr et al. | 208/8 LE |
| 4,390,411 | 6/1983 | Scinta et al. | 208/11 LE |

*Primary Examiner*—Andrew H. Metz
*Assistant Examiner*—William G. Wright

[57] ABSTRACT

A coal liquefaction system is disclosed with a novel preasphaltene recycle from a supercritical extraction unit to the slurry mix tank wherein the recycle stream contains at least 90% preasphaltenes (benzene insoluble, pyridine soluble organics) with other residual materials such as unconverted coal and ash. This subject process results in the production of asphaltene materials which can be subjected to hydrotreating to acquire a substitute for No. 6 fuel oil. The preasphaltene-predominant recycle reduces the hydrogen consumption for a process where asphaltene material is being sought.

8 Claims, 2 Drawing Figures

COAL LIQUEFACTION WITH PREASPHALTENE RECYCLE

The Government of the United States of America has rights in this invention pursuant to Contract No. DE-AC05-780R03054, (as modified) awarded by the U.S. Department of Energy.

CROSS-RELATED APPLICATIONS

This application is a continuation-in-part of Ser. No. 543,201, filed Oct. 19, 1983, now abandoned all of the teachings of which are herein incorporated by reference.

BACKGROUND OF THE INVENTION

This invention relates to a process for the liquefaction of carbonaceous solid fuels, particularly coals, enhanced with respect to the production of asphaltene-rich solvent refined coal wherein the recycle stream passed back to the slurry mix tank contains a predominant amount of preasphaltenes and solid residue in the near or relative near absence of asphaltenes to mitigate the amount of total hydrogen consumed in the process.

This process is directed to the liquefaction of a coal material to prepare, as a product of the process, an asphaltene-rich solvent refined coal, which may be hydrotreated to different products. Many such processes have been directed to such solvent refinement of coal in the presence of a hydrogen donor. This process is different from the prior art in re the type and content of the recycle stream passed from a solvent deashing zone to the slurry mix tank. This recycle stream is a predominant preasphaltene and solid residue stream, which is antithetical to the prior art which normally transfers in the recycle stream from a critical solvent deashing zone either asphaltenes, or hydrotreated asphaltenes with distillate product in admixture therewith, to the slurry mix tank. In such a liquefaction process the heating and the liquefaction of the coal yields light gases and a slurry which is further processed by vacuum distillation to produce a light distillate product, a recycle solvent, and a heavy fraction having residual solvent, dissolved coal products, undissolved minerals and ash materials plus unconverted coal macerals.

PRIOR ART

It is well known that coal liquefaction product separation may be achieved by subjecting the vacuum still bottoms to a deashing process. One such technique is referred to as "critical solvent deashing." Such a process is disclosed in U.S. Pat. No. 4,070,268. As indicated in that patent, the products of the critical solvent deashing process include a stream which is rich in coal products, soluble in pyridine, benzene, or toluene, but which is essentially free of ash and unconverted particulate coal. A bottom stream is also produced which includes insoluble coal products and ash. Finally, an overhead stream of distillate is produced which is recycled as solvent in the deashing process.

As shown by U.S. Pat. No. 4,164,466, the solvent deashing stage often comprises several separation zones, each maintained at successively higher pressures and at high temperatures. This patent also discloses a process wherein the underflow stream of the second zone in the deashing stage is recycled to the entry mixing zone in the deashing stage.

In the process disclosed in U.S. Pat. No. 4,189,372, a portion of the underflow from the third and fourth separators is hydrogenated and recycled to the coal liquefaction slurry tank. Substantially all other intermediate streams from the second through the fourth separators are recycled to the entry mixing zone of the solvent deashing stage as in the '466 patent.

In U.S. Pat. No. 4,119,523, the underflow from the first separator in the solvent deashing stage is extracted to separate the resulting ash and undissolved coal, and the remaining extract recycled to the coal liquefaction stage.

U.S. Pat. No. 4,230,556 discloses the recycling of separator bottoms from immediately downstream of the coal liquefaction reactor. It is known that recycle of a mineral-containing stream to the slurry mix zone enhances the conversion of normally solid dissolved coal in the liquefaction reactor.

U.S. Pat. Nos. 4,377,464 and 4,338,182 describe liquefaction processes wherein a solid residue material is withdrawn from a vacuum distillation zone. If these disclosures were combined with U.S. Pat. No. 4,070,268 they would result in a process tantamount to the flow scheme shown in instant FIG. 1 from the coal in conduit 4 through the supercritical extraction performed in supercritical extraction unit 45. However, the recycle in these two coal liquefaction processes is very different from that recycled in this invention.

U.S. Pat. No. 4,251,346 utilizes a supercritical separator to remove unreacted material and ash residue from the liquefaction process. This exorcism is shown in conduit 4 of FIG. 1 or conduit 13 of FIG. 2. After a downstream distillation from the supercritical separator, a composite recycle stream is formed of distillates and all of the heavy material that boils above 450° C. egressing from the bottom of the distillation column. This recycle stream will contain both asphaltene and preasphaltene materials alike in addition to the distillate obtained in the 100° to 200° C. range. This disclosure lacks any supercritical extraction downstream of the fractionation unit to treat the residual bottoms, i.e. conduit 9 of FIG. 1 and conduit 12 of FIG. 2, and does not separate any asphaltene from preasphaltene materials before recycle. The product sought in '346 is gasoline and crude distillate oil products in deference to the asphaltene product sought in this invention.

In U.S. Pat. No. 4,334,977 a middle distillate material is withdrawn from an atmospheric distillation unit downstream of a liquefaction reactor and hydrotreated for passage back to the liquefaction zone as recycle solvent. The heavy materials commonly denoted as residue and preasphaltene materials are extracted in solvent extractor 40 and removed from the process in conduit 42. A portion of the solvent extractor effluent containing the asphaltene materials is removed through conduits 48 and 47 and a portion of it may be recycled back to the liquefaction unit as recycle solvent. Thus, the recycle stream is an admixture of hydrotreated distillate products, unhydrotreated distillate products and asphaltene material.

Notwithstanding the above prior art, there remains a need for a different type of recycle system of different composition to mitigate the amount of hydrogen utilized in the reaction zone during liquefaction while maximizing the amount of asphaltene product and avoiding undesirable preasphaltenes in the asphaltene product. The preasphaltenes in the asphaltene product are to be avoided because of their high softening point and high heteroatom content. An asphaltene product relatively free of preasphaltenes can be hydrotreated to acquire a substitute for No. 6 fuel oil.

It is therefore a general object of the present invention to provide such a novel recycle stream for a coal liquefaction process and thereby improve the same.

BRIEF DESCRIPTION OF THE INVENTION

The present invention involves a solvent coal refining process in which, following liquefaction and light gas separation, the coal slurry is subjected to vacuum distillation, the bottom stream of which is solvent extracted. This solvent extraction includes one or more separation steps at elevated temperature and pressure, using a supercritical extraction solvent which extracts oils (pentane soluble organics) and asphaltenes (pentane insoluble, benzene soluble organics), from preasphaltenes (benzene insoluble, pyridine soluble organics), solid organic residue materials (pyridine insoluble organics) and ash.

The materials extracted from the supercritical extraction unit may be classified as extract oils and asphaltenes in one stream and preasphaltenes and solid residue material in another or second stream. These particular components, i.e. asphaltenes and preasphaltenes, are not generally nomenclated by their boiling point because of their disposition to chemically decompose upon heating at high temperatures. While it may be possible in theory to obtain a boiling point of any substance, by the time these substances boil, their characteristics will have been changed by thermal cracking of the material and thereby a boiling point of the asphaltenes and preasphaltenes cannot be ascertained in practice. Therefore, these streams can be defined only by their solubility factors. As recognized by those familiar in defining products of coal liquefaction processes, asphaltenes are defined as those materials which are pentane insoluble and benzene soluble, while preasphaltenes are defined as those materials which are benzene insoluble and pyridine soluble. The desired product of this invention, that is asphaltenes which can contain some oils may be hydrotreated to yield an acceptable substitute for No. 6 fuel oil.

The technique of supercritical extraction exploits the optimum combination of fluid properties near their critical point. This is performed in process step 45 of FIGS. 1 and 2 of the instant drawings. These properties are inclusive of liquid-like densities yielding liquid-like dissolving power, and gas-like diffusivities yielding high mass transfer rates. The rapid changes in density with only slight changes in temperature or pressure can be exploited in separation of the solvent from the extract following supercritical extraction. A portion of the preasphaltene and solid residue materials can continuously or intermittently be withdrawn from the process to avoid solids build-up, however, it is preferred that recycle of a predominant amount of these preasphaltenes and solid residue material be channeled to the slurry tank. While it is within the scope of this invention that some asphaltene material may be recycled in concomitant interaction with the preasphaltene materials, it is preferred that at least a 8:1 ratio of preasphaltenes to asphaltenes be maintained in the recycle stream. By performing this process, with this particular preferred recycle stream, there results a net reduction in the amount of undesirable preasphaltenes made in the process and recovered by supercritical extraction. There also results an increaase in the solids loading of the liquefaction reactor. This ultimately results in a reduction in the amount of hydrogen consumed in the liquefaction step when one is attempting to acquire an asphaltene porduct, which is highly desirable in this type of process. Another advantage is that the process can be regulated to be nearly preasphaltene consuming, i.e. nearly all of the preasphaltene is consumed within the process.

One embodiment of this invention resides in a process for solvent refining coal to make an asphaltene-rich product stream by forming a slurry of finely divided coal and a process solvent therefore, contacting said slurry with a hydrogen-rich gas, heating said slurry in the presence of said hydrogen-rich gas, permitting said heated slurry to react and to dissolve at least some of said coal, adding fresh hydrogen as required to form a liquefied coal slurry, passing said liquefied coal slurry to a separator in which a vapor product stream and a condensed product stream are separated, passing the condensed product stream to a vacuum distillation still, and removing therefrom a residual bottoms product, wherein said residual bottoms product from said vacuum distillation still is mixed with a suitable extraction solvent and passed to an extraction system to separate an extract asphaltene-rich product stream from a preaphaltene-rich stream containing solid residue material, withdrawing and recycling at least a portion of said preasphaltene-rich stream containing said solid residue material in the near absence of asphaltenes to said slurry of finely divided coal as process solvent, withdrawing said asphaltene-rich stream and passing said asphaltene-rich stream to a solvent recovery system to recover an asphaltene-rich product stream and an extraction solvent stream, recovering and recycling said extraction solvent stream to said admixture with said vacuum still residual bottoms and recovering said asphaltene-rich stream from said solvent recovery system as said product stream.

Yet another embodiment of this invention resides in a process for solvent refining coal to make an asphaltene-rich product stream by forming a slurry of finely divided coal and a process solvent therefor, contacting said slurry with a hydrogen rich gas, heating said slurry in the presence of said hydrogen rich gas, permitting said heated slurry to react and to dissolve at least some of said coal, adding fresh hydrogen as required to form a liquefied coal slurry, passing said liquefied coal slurry to a separator in which a vapor product stream and a condensed product stream are separated, passing the condensed product stream to a vacuum distillation still, and removing therefrom a residual bottoms product which is passed from the vacuum distillation still to mix with a solvent and then passed to a supercritical extraction system to separate an extract asphaltene-rich stream as the product stream of the process and a preasphaltene-rich stream containing solid residue material, withdrawing and recycling a portion of said preasphaltene-rich materials with asphaltenes in a ratio of at least eight times the amount of preasphaltenes in the recycle to the amount of asphaltenes in the recycle and hydrotreating the asphaltene material to provide a substitute for No. 6 fuel oil.

DETAILED DESCRIPTION OF THE INVENTION

For a better understanding of the present invention, reference may be made to the detailed description which follows, taken in conjunction with the accompanying figures and the claims.

Figure 1:
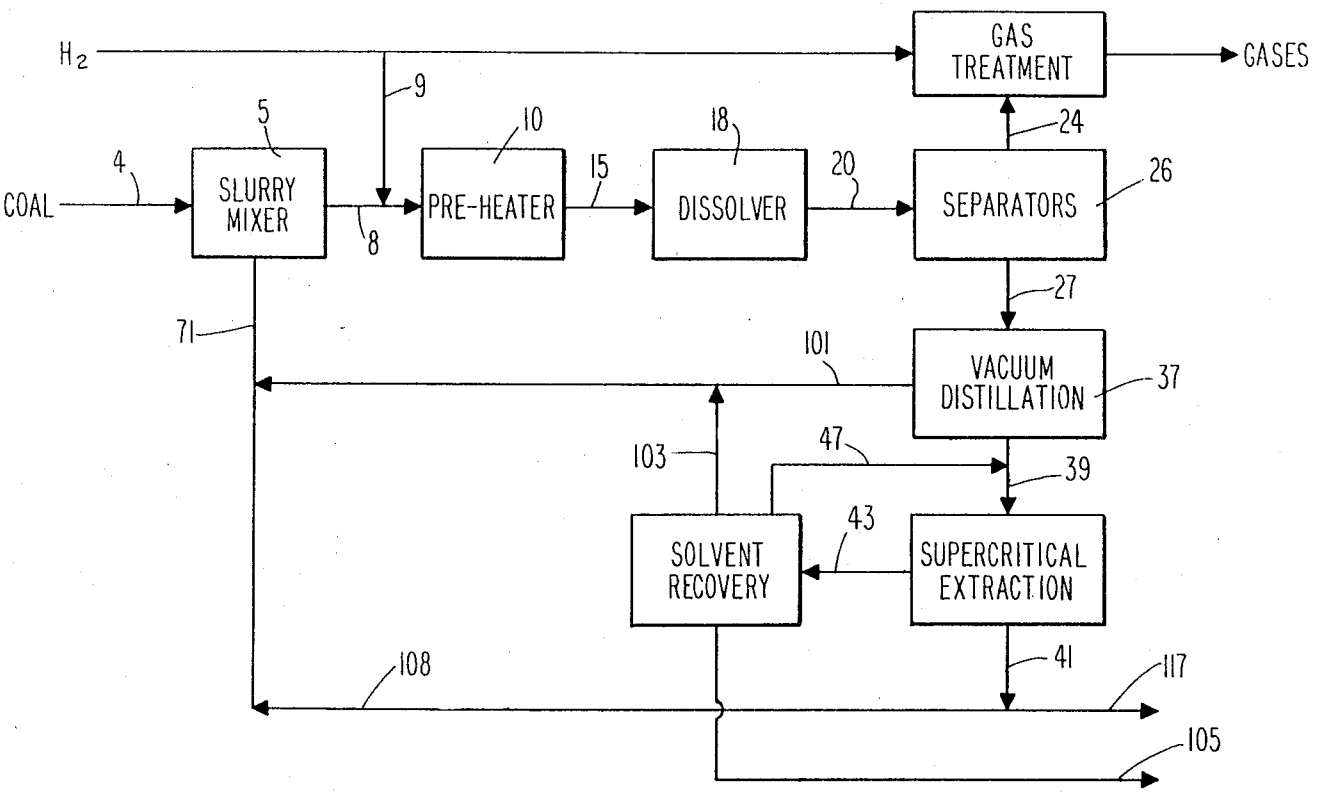
FIG. 1 is a schematic flow diagram of a coal liquefaction process with a supercritical extraction stage and a preasphaltene-rich recycle to the slurry mix tank, which is a process improvement of the present invention.

As shown in FIG. 1, the improved liquefaction process of this invention comprises a coal liquefaction slurry mix zone 5 to which is introduced a feed stream 4 of finely divided coal and solvent (to the extent required) and a recycle stream 71. Slurry from mix zone 5 is pressurized and passed through line 8 to preheater 10 and then through transfer line 15 to dissolver 18. Liquefaction of coal in the heated slurry is enhanced by hydrogenation; for that purpose, hydrogen is introduced to the slurry through feed line 9 in transfer line 8.

After suitable residence time in dissolver 18, the coal solvent slurry mixture is passed through transfer line 20 to separator zone 26, in which light stream 24 is flashed off, following which the slurry is passed through transfer line 27 to a vacuum distillation stage 37, from which a distillate product is recycled through transfer line 101 and a vacuum distillation bottom stream is passed through transfer line 39 to a supercritical extraction stage 45. The extract fraction is passed through transfer line 43 to a solvent recovery stage from which extraction solvent is recycled through transfer line 47 to the input to the extraction stage. Extraction step 45 will separate asphaltene from preasphaltene components. The heavier material, i.e. the preasphaltenes in admixture with solid residue material such as unreacted coal and ash, is removed in conduit 41 while a portion of the solvent plus the asphaltene materials, those being pentene insoluble and benzene soluble, are passed from extraction unit 45 through conduit 43 to solvent recovery unit 51. The asphaltenes are separated therein and can be removed from the process through conduit 105 or a very minor portion (less than 10% of the total recycle stream) of the asphaltenes can be recycled to the slurry tank by means of conduits 103 and 101 through conduit 71. It is preferred in this invention, however, that the predominant portion of the recycle is the preasphaltenes and solid residue material. It is also preferred that this relationship be maintained in at least an 8:1 relationship in favor of the preasphaltenes and solid residue material in order to mitigate hydrogen consumed in the process. It is also possible to remove some of the preasphaltenes from the solid materials in conduit 117. To avoid solids build-up in the liquefaction dissolver, some residue, ash and some tag-along preasphaltenes should be exorcised from the process in conduit 117. If necessary, an additional separation zone may be placed in conduit 117 to extract preasphaltenes from the solid residue and ash. In this manner, the process could be regulated to be nearly preasphaltene-consuming, i.e. nearly all the preasphaltenes will be consumed in the total process scheme and need not be handled extrinsic from the process.

Figure 2:
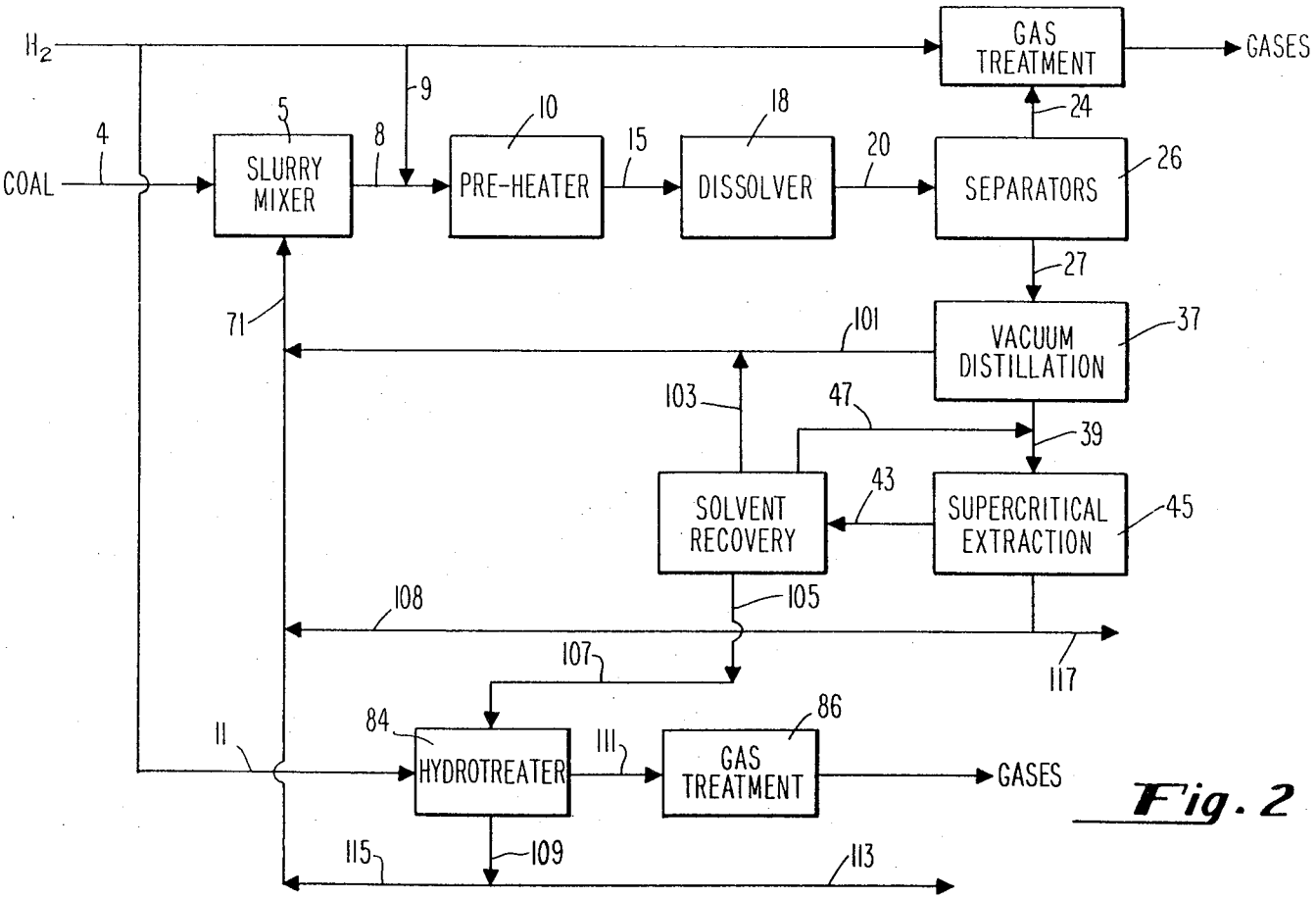
FIG. 2 is a schematic flow diagram of a coal liquefaction process with a supercritical extraction stage, a hydrotreatment stage and a preasphaltene-rich fraction recycling step, which is a process improvement of the present invention.

A further embodiment of the present invention is shown in FIG. 2. The output stream of transfer line 105 of FIG. 1 is passed through transfer line 107 to hydrotreatment zone 84. Hydrogen rich gas is fed to hydrotreater 84 through line 11. The bottom stream from hydrotreater 84 is passed through line 109 and withdrawn as product via line 113. A portion of the hydrotreated material may be recycled to the head of the process through line 115. The light overflow stream from hydrotreater 84 is passed through transfer line 111 to gas treatment zone 86.

The following examples are given as being representative of this invention but should not be considered as an unduly limited restriction thereon. The examples succinctly show a liquefaction process wherein the recycle stream consists in at least a 8:1 ratio of preasphaltenes to asphaltenes.

EXAMPLE 1

A slurry mixture of 30 wt% Ky. #9 coal, 15 wt% SRC ash concentrate, and 55 wt% SRC process solvent was fed at a rate of 1650 g./hr., together with 48 g./hr. hydrogen gas, to a one liter coal liquefaction reactor. Based on solvent separation analysis of the slurry feed components, it had the following composition:

TABLE I

| | wt % |
|---|---|
| MAF Coal | 25.5 |
| Moisture in coal | 0.6 |
| Ash in Coal | 3.9 |
| Pentane - soluble organic (oils) | 53.6 |
| Benzene - soluble/pentane - insoluble (asphaltenes) | 1.3 |
| Benzene - insoluble organics (preasphaltenes and solid organic residue material) | 11.1 |
| Ash (from solvent & ash concentrate) | 4.0 |
| Total | 100.0 |

The reactor was operated at 840° F. (454° C.) and 2000 psig (13794 kPa).

Based on average yields of two experimental trials, the resulting reactions consumed 10 g./hr. of hydrogen (equivalent to 0.6 wt% of the slurry feed), and yielded the following product:

TABLE II

| | wt % (of slurry feed) |
|---|---|
| Ash | 7.9 |
| Preasphaltenes and solid organic residue material | 16.1 |
| Asphaltenes | 12.6 |
| Oils | 60.4 |
| $C_1$-$C_5$ hydrocarbon gas | 1.5 |
| Other gases & water | 2.1 |
| Total | 100.6 |

The separation of the gross product stream (i.e., only to that fraction (97%) which is neither water nor gas), into a recycle stream, an ash-containing reject stream, and a "product" stream results in the following compositions:

TABLE III

| Stream | Recycle | Reject | Product | Total |
|---|---|---|---|---|
| | Flow rate (g./100 g. feed slurry) | | | |
| Ash | 4.0 | 3.9 | 0.0 | 7.9 |
| Preasphaltene and solid organic residue materials | 11.1 | 5.0 | 0.0 | 16.1 |
| Asphaltenes | 1.3 | 0.0 | 11.3 | 12.6 |
| Oils | 53.6 | 0.0 | 6.8 | 60.4 |
| Totals | 70.0 | 8.9 | 18.1 | 97.0 |

The net products of the overall process expressed in terms of feed coal are as follows:

TABLE IV

| Product | Yield (g./100 g. feed coal) |
|---|---|
| Asphaltene-rich product | 60.3 |
| Reject | 29.7 |
| Hydrocarbon gases | 5.0 |
| Other gases & water | 7.0 |
| $H_2$ consumed | (2.0) |
| Total | 100 |

The asphaltene-rich product consists primarily (approximately 62 wt%) of non-distillate material. Thus, this example shows that distillation alone is insufficient to effect the necessary separation.

EXAMPLE 2

The following example is given as being representative of a liquefaction process without a preasphaltene-rich recycle stream.

A slurry mixture of 30 wt% Ky. #9 coal and 70 wt% SRC process solvent was fed at a rate of 1650 g./hr., together with 48 g./hr. hydrogen gas, to a one liter coal liquefaction reactor. Based on solvent separation analysis of the slurry feed components, it had the following composition:

TABLE V

| | wt % |
|---|---|
| MAF Coal | 25.5 |
| Ash in Coal | 3.9 |
| Moisture in Coal | 0.6 |
| Oils | 68.2 |
| Asphaltenes | 1.3 |
| Preasphaltenes + Solid Organic Residue | 0.5 |
| Total | 100.0 |

The reactor was operated at 840° F. (454° C.) and 2000 psig (13794 kPa). The resulting reactions consumed 8 g./hr. of hydrogen (equivalent to 0.5 wt% of the slurry feed), and yielded the following product:

TABLE VI

| | |
|---|---|
| Ash | 3.9 |
| Preasphaltenes + Solid Organic Residue | 11.7 |
| Asphaltenes | 9.1 |
| Oils | 72.4 |
| $C_1$-$C_5$ Hydrocarbon Gas | 1.5 |
| Other Gas + Water | 1.9 |
| Total | 100.5 |

Recovery of recycle and a comparable asphaltene plus net oil product leads to the following:

TABLE VII

| | Flow Rate (g./100 g. feed slurry) | | | |
|---|---|---|---|---|
| Stream | Recycle | Reject | Product | Total |
| Ash | 0.0 | 3.9 | 0.0 | 3.9 |
| Preasphaltenes + Solid Organic Residue | 0.5 | 11.2 | 0.0 | 11.7 |
| Asphaltenes | 1.3 | 0.0 | 7.8 | 9.1 |
| Oils | 68.2 | 0.0 | 4.2 | 72.6 |
| Totals | 70.0 | 15.1 | 12.0 | 97.1 |

The net products of the overall process expressed in terms of feed coal are as follows:

TABLE VIII

| Product | Yield (g./100 g. feed coal) |
|---|---|
| Asphaltene-rich Product | 40.0 |
| Reject | 50.3 |
| Hydrocarbon Gases | 5.0 |
| Other gases + Water | 6.3 |
| $H_2$ Consumed | (1.6) |

These examples verify the goals sought by the applicants in their process for the production of asphaltene-rich compositions which could be hydrotreated to arrive at a No. 6 fuel oil with corresponding consumption of as little hydrogen as necessary to acquire the asphaltene compositions. A comparison of the products produced from this invention, wherein the recycle is comprised substantially of recycle oil and preasphaltenes (Example 1), with that of the case where no preasphaltenes are recycled (Example 2), demonstrates that preasphaltene recycle results in favorable conversion to desirable asphaltene-rich products.

This invention (Example 1) produces 20% more desirable asphaltene-rich products than is derived in Example 2 where no preashaltenes were recycled, and consequently 20% more reject resulted. Furthermore, a comparison of the data points of these two examples shows that the increased amount of hydrogen necessary to acquire the asphaltene-rich compositions through reactions of preasphaltenes and coal is surprisingly small (2.0% in Example 1 as compared to 1.6% in Example 2). When viewed in lieu of the increased yields of asphaltene product from this invention, the amount of hydrogen consumed per amount of desired product is unexpectedly significantly better. In a process using this invention (in Example 1) there is 33.3 mg $H_2$ consumed/g. product as compared to 40.0 mg $H_2$ consumed/g. product for a process performed with no preasphaltene recycle (Example 2) and yielding 20% fewer asphaltenes. That is, in our invention, the higher yields of desirable product favor the overall conservation of hydrogen.

We claim:

1. A process for solvent refining coal to yield an asphaltene-rich product stream by forming a slurry of finely divided coal and a process solvent therefor, which process comprises the steps of:
   (1) contacting said slurry with a hydrogen-rich gas;
   (2) heating said slurry in the presence of said hydrogen-rich gas;
   (3) permitting said heated slurry to react and to dissolve at least some of said coal;
   (4) adding fresh hydrogen as required to form a liquefied coal slurry;
   (5) passing said liquefield coal slurry to a separator in which a vapor product stream and a condensed product stream are separated;
   (6) passing the condensed product stream to a vacuum distillation still;
   (7) removing from the vacuum distillation still a residual bottoms product, wherein said residual bottoms product from said still is mixed with a suitable extraction solvent and is passed to a supercritical extraction system to separate an asphaltene-rich stream comprised of pentane solubles and benzene solubles from a preasphaltene-rich stream which includes solid residue material, said preasphaltene-rich stream comprised of benzene insolubles, pyridine solubles, pyridine insolubles and ash;
   (8) recycling at least a portion of said preasphaltene-rich stream together with said solid residue material as process solvent, with less than 10 percent of said process solvent comprising asphaltenes;

(9) withdrawing said asphaltene-rich stream and passing said asphaltene-rich stream to a solvent recovery system to yield an asphaltene-rich product stream and an extraction solvent stream;

(10) recovering and recycling said extraction solvent stream from step (9) to said vacuum distillation still in step (6); and

(11) recovering said asphaltene-rich stream from said solvent recovery system as said product stream.

2. The process of claim 1 wherein said product asphaltenes are contacted with hydrogen to produce a hydrotreated asphaltene stream.

3. The process of claim 1 wherein said asphaltenes are pentane insoluble, benzene soluble and the preasphaltenes are benzene insoluble, pyridine soluble.

4. The process of claim 1 wherein said solvent for said solvent extraction is selected from the group consisting of alcohols, ketones, benzene, toluene, ethylbenzene, p-xylene and combinations thereof.

5. The process of claim 1 wherein said preasphaltenes are nearly totally consumed within said process to eliminate any net production of said preasphaltenes extrinsic from those removed with said ash and solid residue materials.

6. The process of claim 1 wherein solid materials and ash are intermittently removed from said process through extraction of a portion of said preasphaltene recycle stream.

7. The process of claim 6 wherein said preasphaltene recycle stream is passed to a preasphaltene separation zone in which said preasphaltenes are separated from said solid material and ash and said preasphaltenes are recycled to said slurry mix tank.

8. The process of claim 7 wherein the total content of preasphaltenes recovered from said preasphaltene separation zone are recycled to said slurry mix tank.

* * * * *